United States Patent [19]

Chen

[11] Patent Number: 4,951,812

[45] Date of Patent: Aug. 28, 1990

[54] STRUCTURE OF TOOL CASE

[76] Inventor: Kun-Chen Chen, No. 6, Lane 609, Sec. 1, Chung Shan Rd., Ta Chia Chen, Taichung, Taiwan

[21] Appl. No.: 464,074

[22] Filed: Jan. 12, 1990

[51] Int. Cl.[5] ..... B65D 25/14

[52] U.S. Cl. ..... 206/45.11; 190/16; 206/373

[58] Field of Search ..... 190/16, 17, 117; 206/44.11, 45.11, 370–378; 220/6, 7, 20

[56] References Cited

U.S. PATENT DOCUMENTS

| | | | |
|---|---|---|---|
| 695,326 | 3/1902 | Morris | 190/16 |
| 715,967 | 12/1902 | Briggs | 190/16 |
| 789,782 | 5/1905 | Yates | 206/45.11 |
| 2,539,302 | 1/1951 | Fye | 190/16 |
| 2,718,447 | 9/1955 | Wright | 220/6 |
| 3,540,576 | 11/1970 | Pierce | 190/16 |
| 3,717,228 | 2/1973 | Blair | 190/117 |

FOREIGN PATENT DOCUMENTS

| | | | |
|---|---|---|---|
| 3717226 | 2/1988 | Fed. Rep. of Germany | 190/16 |
| 0373219 | 5/1973 | U.S.S.R. | 190/16 |
| 0155626 | 12/1920 | United Kingdom | 206/373 |

*Primary Examiner*—Jimmy G. Foster

*Attorney, Agent, or Firm*—Varndell Legal Group

[57] ABSTRACT

A tool case, which includes a plurality of pairs of casings respectively connected in series by means of connecting strip portions therebetween, permitting two casings to relatively turn outward with the adjacent two casings capable of being relatively turned inward so that the intermediate casings can be completely received in a space which is defined by the first and the last casings when the first and the last casings are relatively turned inward to close up together. The casings comprises a variety of recess holes for receiving a variety of hand tools. The first and the last casings have hand-hold portions which can be incorporated together for the holding of the hand when the casings are relatively closed up together.

1 Claim, 3 Drawing Sheets

STRUCTURE OF TOOL CASE

BACKGROUND OF THE INVENTION

The present invention is related to a multi-deck tool case and more particularly to the one which includes a plurality of pairs of casings relatively connected together for receiving a variety of hand tools therein.

The conventional tool case is generally comprised of an upper casing and a bottom casing having symmetrically disposed recess holes for the setting therein of a variety of hand tools. For receiving more quantity of hand tools, a tool case must be greatly increased in full size. However, a big tool case is not convenient for the carriage with the hand.

An object of the present invention is to provide such a multi-deck tool case which provides maximized room for receiving a big quantity of different hand tools with minimized space occupation.

Another object of the present invention is to provide such a multi-deck tool case which can be conveniently extended out into a flat structure and closed up into a case-like structure.

Still another object of the present invention is to provide such a tool case which is simple and inexpensive to manufacture.

DETAILED DESCRIPTION OF THE PREFERRED EMBODIMENT

Figure 1:
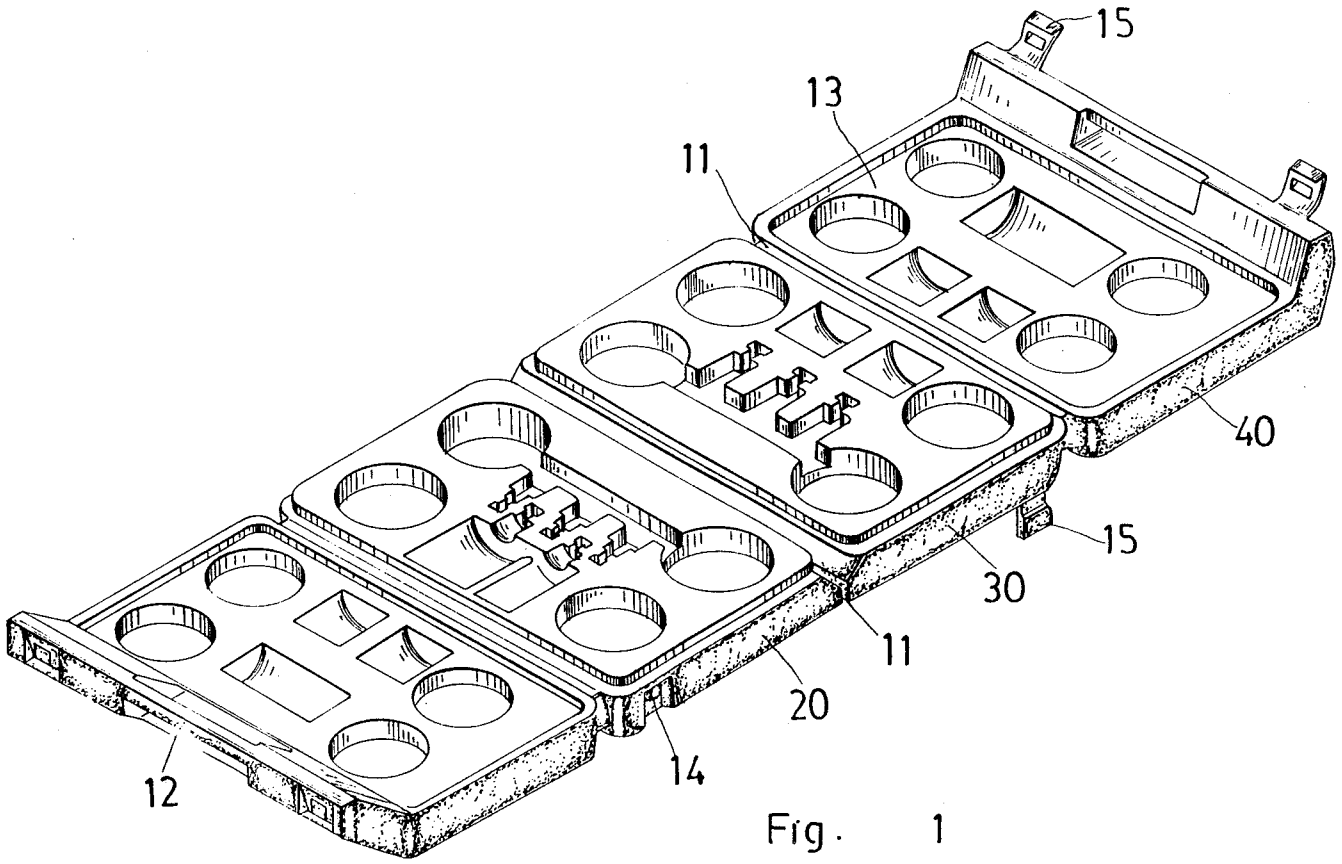
FIG. 1 illustrates an extended condition of a multi-deck tool case in accordance with the present invention.

Turning now to the annexed drawings in greater detail and referring to FIG. 1, therein illustrated is a multi-deck tool case in accordance with the present invention and generally comprised of four casings (10), (20), (30) and (40) unitarily made through shape molding process. As illustrated, the four casings, i.e. the first casing (10), the second casing (20), the third casing (30) and the fourth casing (40) are respectively connected in series by means of respective connecting strip portions (11). An unitary hand-hold portion (12) is respectively made on each of the two outer casings (10) and (40) at an outer center location. A variety of recess holes (13) are symmetrically made on the four casings (10), (20), (30) and (40) for the setting therein of a variety of hand tools. A pair of retainer means (15) are made on the fourth casing (40) at both lateral sides of its hand-hold portion (12) corresponding to a pair of retaining holes (14) which are made on the first casing (10) at both lateral sides of its hand-hold portion (12). The third casing (30) also comprises two retainer means (15) on its two side-wall portions corresponding to two retaining holes (14) which are made on the second casing (20) on its two side-wall portions. The connecting strip portion (11) between the first and second casings (10) and (20) as well as the connecting strip portion (11) between the third and fourth casings (30) and (40) are respectively made at an upper position, while the connecting strip portion (11) between the second and third casings (20) and (30) is made at a bottom position. Therefore, the second and third casings (20) and (30) are permitted to turn outward relative to each other, and the first and fourth casings (10) and (40) are permitted to turn inward relative to the second and third casings (20) and (30) respectively.

Figure 2:
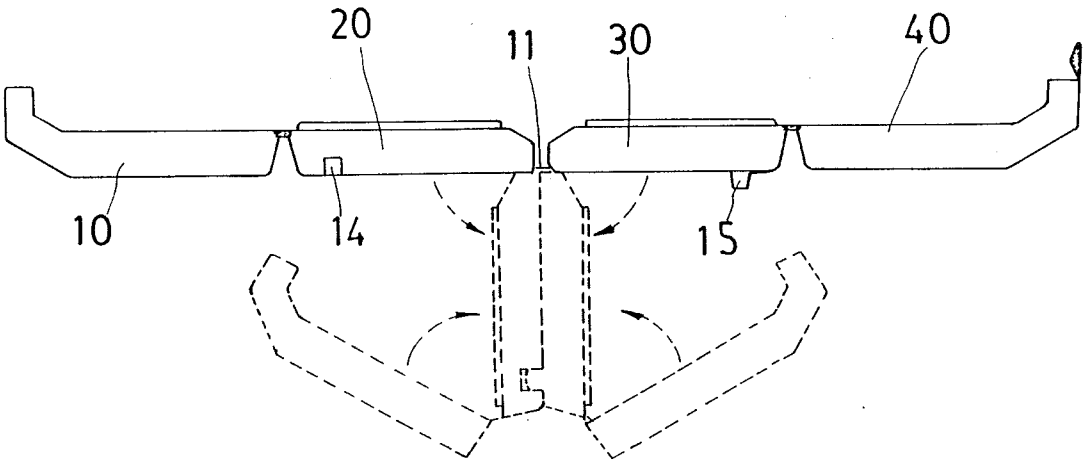
FIG. 2 is a schematic drawing, illustrating the operation of the tool case of FIG. 1 from its extended position to a closed position.
Figure 3:
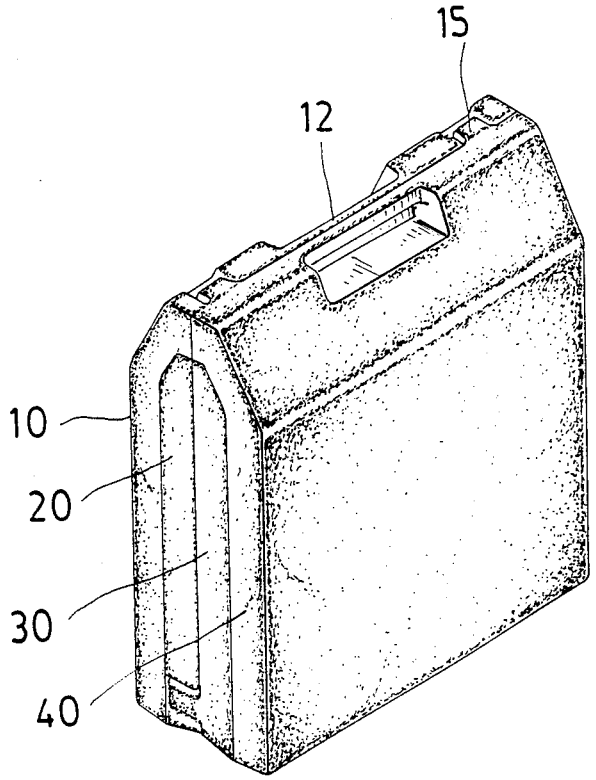
FIG. 3 illustrates the outer appearance of the tool case of FIG. 1.

Referring to FIG. 2, after the second and third casings (20) and (30) are relatively turned outward and the first and fourth casings (10) and (40) are relatively turned inward, the two retainer means (15) of the third casing (30) are respectively engaged with the two retaining holes (14) of the second casing (20), and the two retainer means (15) of the fourth casing (40) are respectively engaged with the two retaining holes (14) of the first casing (10). Thus, a hand case in an enclosed condition is set up (see FIG. 3). Through the hand-hold portions (12), the hand case can be conveniently carried with the hand. When in use, the retainer means (15) are respectively disengaged from the retaining holes (14), permitting the four casings (10), (20), (30) and (40) to be extended for putting a variety of hand tools to or picking up a variety of hand tolls from the variety of recess holes (13). When not in use, the four casings (10), (20), (30) and (40) can be conveniently closed up to form into a structure as shown in FIG. 3 which minimizes space occupation.

I claim:

1. A tool case, including a plurality of pairs of casings unitarily made through shape molding process, said casings having symmetrically a variety of recess holes thereon for the setting therein of a variety of hand tools, a pair of retainer means or retaining holes each for the connection with one another, and being respectively connected in series by means of a connecting strip portion between each two casings, permitting two casings to relatively turn outward with adjacent two casings capable of being relatively turned inward so that the intermediate casings can be completely received inside a space which is defined by the first casing and the last casing when the first casing and the last casings are relatively turned to close up together, said first and last casings having hand-hold portions incorporated together for the holding of the hand when said casings are respectively closed up together.

* * * * *